US008505796B2

(12) United States Patent
Aihara et al.

(10) Patent No.: US 8,505,796 B2
(45) Date of Patent: Aug. 13, 2013

(54) FUEL CARTRIDGE AND GAS-COMBUSTION TYPE DRIVING TOOL

(75) Inventors: Yasunori Aihara, Tokyo (JP); Tatsushi Ogawa, Tokyo (JP); Satoshi Osuga, Tokyo (JP)

(73) Assignee: Max Co., Ltd., Tokyo (JP)

( * ) Notice: Subject to any disclaimer, the term of this patent is extended or adjusted under 35 U.S.C. 154(b) by 353 days.

(21) Appl. No.: 12/464,271

(22) Filed: May 12, 2009

(65) Prior Publication Data

US 2009/0283567 A1 Nov. 19, 2009

(30) Foreign Application Priority Data

May 16, 2008 (JP) ..... 2008-129721

(51) Int. Cl.
*B25C 1/08* (2006.01)
*B67D 7/04* (2010.01)

(52) U.S. Cl.
USPC ..... 227/9; 227/10; 227/11; 222/3

(58) Field of Classification Search
USPC ..... 227/9, 10, 11; 222/3, 105, 325, 222/394, 402.1, 402.14
See application file for complete search history.

(56) References Cited

U.S. PATENT DOCUMENTS

| | | | | |
|---|---|---|---|---|
| 3,294,118 | A * | 12/1966 | Karl-Erich Wieden et al. | 137/588 |
| 3,777,771 | A | 12/1973 | De Visscher | |
| 4,641,785 | A | 2/1987 | Grothe | |
| 4,971,224 | A * | 11/1990 | Scremin | 222/3 |
| 5,730,326 | A * | 3/1998 | Kaeser | 222/95 |
| 6,053,537 | A * | 4/2000 | Guest | 285/148.19 |
| 6,217,085 | B1 | 4/2001 | Toulouse | |
| 6,223,966 | B1 * | 5/2001 | Nayrac et al. | 227/130 |
| 2005/0282048 | A1 * | 12/2005 | Kamo et al. | 429/12 |
| 2006/0129009 | A1 | 6/2006 | Nishikawa et al. | |
| 2006/0210842 | A1 * | 9/2006 | Tezuka et al. | 429/12 |
| 2007/0187426 | A1 * | 8/2007 | Murayama et al. | 222/3 |
| 2007/0251376 | A1 * | 11/2007 | Toulouse et al. | 91/471 |
| 2007/0251967 | A1 | 11/2007 | Taylor et al. | |
| 2008/0000451 | A1 | 1/2008 | Shea et al. | |

FOREIGN PATENT DOCUMENTS

| | | | |
|---|---|---|---|
| DE | 201 14 780 | U1 | 1/2002 |
| EP | 0 041 022 | A1 | 12/1981 |
| EP | 0 471 503 | A2 | 2/1992 |
| JP | 48-2313 | | 1/1973 |
| JP | 61-30269 | | 2/1986 |
| JP | 61-150600 | | 9/1986 |
| JP | 6-220910 | | 8/1994 |
| JP | 07190336 | A * | 7/1995 |
| JP | 11-101400 | | 4/1999 |
| JP | 2002-192479 | | 7/2002 |

(Continued)

*Primary Examiner* — M. Alexandra Elve
*Assistant Examiner* — Nathaniel Chukwurah
(74) *Attorney, Agent, or Firm* — Drinker Biddle & Reath LLP

(57) ABSTRACT

A fuel cartridge, which is capable of being mounted on a tool main body of a gas-combustion type driving tool so as to supply fuel gas to a striking mechanism of the tool main body, is provided with an ejection nozzle provided at a port portion formed at an end portion of a cartridge main body and slidable with respect to the cartridge main body; a compression spring for biasing the ejection nozzle so that a tip end of the ejection nozzle protrudes from the cartridge main body; and an ejection hole formed at a side wall of a tip end portion of the ejection nozzle.

17 Claims, 10 Drawing Sheets

(56) References Cited

FOREIGN PATENT DOCUMENTS

| | | |
|---|---|---|
| JP | 2002-362603 | 12/2002 |
| JP | 2005-342823 | 12/2005 |
| JP | 2006-46691 | 2/2006 |
| JP | 2006-152024 | 6/2006 |
| JP | 2009-180277 | 8/2009 |
| WO | WO 94/16970 | 8/1994 |

* cited by examiner

FUEL CARTRIDGE AND GAS-COMBUSTION TYPE DRIVING TOOL

BACKGROUND OF THE INVENTION

1. <Field of the Invention>

The present invention relates to a fuel cartridge in which fuel gas is filled and also relates to a driving tool such as a gas-combustion type nailing machine which explosively combusts fuel gas supplied from the fuel cartridge to thereby drive a striking mechanism.

2. <Background Art>

In a first example of the known coupling portion of a fuel cartridge to a machine main body, a passage communicating from a coupling portion to a fuel measuring device is formed on the machine main body side having the coupling portion for connecting the fuel cartridge so that fuel supplied from the fuel cartridge is supplied to the combustion chamber of the machine via the fuel measuring device. The fuel cartridge is coupled via the coupling portion in a manner that a male nozzle member having a nozzle opening at the center of a projection portion on the fuel cartridge side and a female nozzle member having a nozzle opening at the center of the projection portion at the lower portion of a solenoid on the machine main body side are pushed and inserted into a seal holder housing a seal member which is a coupling member capable of being held by a bush member at the lower portion of the solenoid (see a patent document 1, for example).

In a second example, an adaptor housing a seal member at the time of coupling is set on the nozzle side of a fuel cartridge, whereby the nozzle (fuel cell system) is protected from the outside by the adaptor. The fuel cartridge is attached in a manner that when the fuel cartridge disposed in a fuel cell chamber is pushed in toward one direction, lugs at the outer periphery of the nozzle engage with locking tangs of a latch disposed within the cell chamber. The fuel cartridge is detached in a manner that the locking tangs are disengaged from the lugs at the outer periphery of the nozzle by operating a push button for the latch (see a patent document 2, for example)

[Patent Document 1] U.S. Pat. No. 6,217,085

[Patent Document 2] JP-A-2002-192479

In the first example, in a state that the fuel cartridge is not coupled, the passage of the coupling portion on the machine main body side is opened and further the seal portion of the nozzle of the seal holder as the coupling member is also placed in an exposed state. Thus, dust etc. likely enters into these portions to thereby cause a trouble in the fuel measuring device and the seal portion of the nozzle. Further, since the male nozzle member pushed and inserted into the seal holder is firmly held by the sliding resistor at the seal portion, the nozzle member does not restore to the initial position by a returning load of the nozzle portion of the fuel cartridge at the time of detaching the fuel cartridge. Thus, since it is required to pull out the fuel cartridge at the time of detaching the fuel cartridge, the operability of the attachment/detachment of the cartridge is not good.

In the second example, since the adaptor has the complicated structure and also the structure for attaching/detaching the fuel cartridge is complicated, the attachment/detachment property of the cartridge is not good.

SUMMARY OF THE INVENTION

One or more embodiments of the invention provide a fuel cartridge and a gas-combustion type driving tool in which a fuel passage of the fuel cartridge is surely secured without causing a trouble, a structure of a port portion of the fuel cartridge is simple, and an attachment/detachment of the fuel cartridge with respect to a gas-combustion type driving tool can be simply and easily performed.

In accordance with one or more embodiments of the invention, a fuel cartridge, which is capable of being mounted on a tool main body of a gas-combustion type driving tool so as to supply fuel gas to a striking mechanism of the tool main body, is provided with: an ejection nozzle 4 provided at a port portion formed at an end portion of a cartridge main body 1 and slidable with respect to the cartridge main body 1; a compression spring 16 for biasing the ejection nozzle 4 so that a tip end of the ejection nozzle 4 protrudes from the cartridge main body 1; and an ejection hole 17 formed at a side wall of a tip end portion of the ejection nozzle 4. The compression spring 16 biases the ejection nozzle 4 in an axial direction of the ejection nozzle 4. A direction in which the ejection hole 17 extends intersects with the axial direction of the ejection nozzle 4.

According to the above structure, the ejection nozzle is provided at the port portion formed at the end portion of the cartridge main body so as to be slidable freely, and the ejection nozzle is biased by the compression spring so that the tip end thereof always protrudes from the cartridge main body. Thus, since the ejection nozzle is arranged to move slidably against the biasing force of the spring when the cartridge is loaded into the tool main body of the gas-combustion type driving tool, the fuel gas within the fuel cartridge can be supplied to the tool main body simultaneous with the loading of the fuel cartridge.

In addition, since the ejection hole for the fuel gas is formed at the side wall of the tip end portion of the ejection nozzle, the ejection hole is not closed even if the tip end of the ejection nozzle is pushed against a floor etc., whereby residual gas can be exhausted efficiently. The ejection hole of the ejection nozzle may be closed at the tip end thereof or formed in a groove shape so long as the ejection hole is configured to be able to exhaust the fuel gas to the side direction of the ejection nozzle.

The fuel cartridge may further includes a valve 11, 15 disposed at the port portion. The valve 11, 15 may open when the ejection nozzle 4 slides against a biasing force of the spring 16.

According to the above structure, the valve body is disposed at the port portion, and an opening/closing mechanism is opened when the ejection nozzle slides against the biasing force of the spring. Thus, the nozzle slides simultaneous with the loading of the fuel cartridge and so the fuel gas within the fuel cartridge can be supplied to the tool main body.

The fuel cartridge may further includes an adaptor sleeve 18 provided at a periphery of the ejection nozzle 4.

According to the above structure, since the adaptor sleeve is provided at the periphery of the ejection nozzle in the main body of the cartridge, the ejection nozzle can be protected from an external force applied from the outside.

Tip end of the ejection nozzle 4 may protrude outward from an opening end of the adaptor sleeve 18.

According to the above structure, the tip end of the ejection nozzle is provided so as to protrude outward from the opening end of the adaptor sleeve, when the tip end of the ejection nozzle 4 is pushed against a suitable member. Thus, since the ejection nozzle is pushed in by a length corresponding to the protruded length from the adaptor sleeve, the opening/closing mechanism can be opened, whereby the remained fuel gas can be exhausted from the ejection hole of the ejection nozzle The fuel cartridge may further includes an inner plate 20 slidable within the adaptor sleeve 18 and having a fitting hole 25 which fits with the ejection nozzle 4. The inner plate 20 may be biased in a direction of protruding to an outside of the adaptor sleeve 18.

According to the above structure, since the inner plate having the fitting hole fitting to the ejection nozzle is provided at the opening end of the adaptor sleeve, the ejection nozzle can be held stably. Further, the seal portion of the opening/closing mechanism of the ejection nozzle can be protected from the outside and the adhesion of dust etc. can be protected. Furthermore, since the inner plate is provided so as to be slidable freely, the inner plate can be slid together with the ejection nozzle and the opening/closing operation of the opening/closing mechanism is not interfered by the sliding operation.

The fuel cartridge may further includes a guide portion 26 provided on the inner plate 20 and for guiding a coupling portion 54 in the tool main body 34 to the ejection nozzle 4.

According to the above structure, since the inner plate is provided with the guide portion for guiding the coupling portion provided at the driving tool to the ejection nozzle, the ejection nozzle can be disposed correspondingly at a predetermined position of the coupling portion.

The inner plate 20 may be biased so as to protrude outward than an opening end of the adaptor sleeve 18.

According to the above structure, the inner plate is biased by the spring so as to protrude outward than the opening end of the adaptor sleeve. Thus, the stable holding and the dust proof of the ejection nozzle can be performed more surely. Further, if the bias spring is arranged to be compressed when the cartridge is attached to the driving tool, the cartridge can be detached by using the biasing force of the bias spring in the case of detaching the cartridge after use.

The compression spring 16, the inner plate 20 and the adaptor sleeve 18 may be disposed coaxially with the ejection nozzle 4.

According to the above structure, since the compression spring, the inner plate and the adaptor sleeve are disposed coaxially with the ejection nozzle, the sliding of each of the ejection nozzle and the inner plate and the expansion/compression of the compression spring are directed in the same direction, whereby the entire mechanism can be configured simply.

The fuel cartridge may further include a cap 30 for covering the inner plate 20 and the ejection nozzle 4 and detachably attached to the adaptor sleeve 18. The cap 30 may include a needle portion 32 capable of being inserted inside of the ejection nozzle 4 from a tip end of the ejection nozzle 4 at a center portion of an inside of the cap 30. An inner diameter of the cap 30 may be slightly larger than an outer diameter of a bottom portion of the fuel cartridge.

According to the above structure, the cap for covering the inner plate and the ejection nozzle is provided at the adaptor sleeve so as to be detachable freely, the needle portion capable of being inserted inside of the ejection nozzle from the tip end thereof is formed at the center portion of the inside of the cap, and the inner diameter of the cap is set so as to be slightly larger than the outer diameter of the bottom portion of the fuel cartridge. Thus, in the case of exchanging the fuel cartridge, the cap of a new fuel cartridge is strongly pushed into and fit to the bottom portion of the old fuel cartridge, whereby the needle portion at the center portion breaks through the bottom portion of the old fuel cartridge to exhaust the compressed gas contained therein. Thus, the spent fuel cartridge can be disposed safely.

Moreover, in accordance with one or more embodiments of the invention, a gas-combustion type driving tool is provided with: a housing portion 52 capable of loading a fuel cartridge A from one end of the housing portion 52, the fuel cartridge A including an ejection nozzle 4 biased by a first compression spring 16 and fuel gas being ejected when the ejection nozzle 4 is pushed with respect to a cartridge main body 1 against a biasing force of the first compression spring 16; a coupling sleeve 61 provided at the other end of the housing portion 52 and capable of inserting the ejection nozzle 4 of the fuel cartridge therein; a nozzle piston 62 slidably housed with in the coupling sleeve 61 and capable of abutting a tip end of the ejection nozzle 4; and a second compression spring 70 for biasing the nozzle piston 62 to a tip end portion side of the coupling sleeve 61. A biasing force of the second compression spring 70 is smaller than the biasing force of the first compression spring 16. After the fuel cartridge A is pushed into the housing portion 52 to move backward the nozzle piston 62 to a movable end thereof by the first compression spring 16, when the fuel cartridge A is further pushed in, the nozzle piston 62 pushes in the ejection nozzle 4 so that the fuel gas is ejected from the ejection nozzle 4 and supplied to a side of the coupling sleeve 61.

According to the above structure, the gas-combustion type driving tool includes the tubular housing portion capable of loading the fuel cartridge from one end thereof, the fuel cartridge is arranged in a manner that the ejection nozzle is provided at the end portion of the main body of the cartridge filled with the fuel gas so as to be slidable freely, the ejection nozzle is biased by the first compression spring so that the tip end thereof always protrudes from the cartridge main body, and the opening/closing mechanism is opened when the ejection nozzle is pushed in against the biasing force of the first compression spring to thereby eject the fuel gas from the ejection nozzle, wherein the coupling sleeve capable of inserting the ejection nozzle of the fuel cartridge therein is provided at the other end of the housing portion, the coupling sleeve houses therein the nozzle piston capable of abutting against the tip end of the ejection nozzle of the fuel cartridge loaded into the housing portion so as to be slidable freely, the nozzle piston is normally biased by the second compression spring so as to locate near the tip end portion of coupling sleeve, the biasing force of the first compression spring is set to be larger than the biasing force of the second compression spring, and after the fuel cartridge is pushed into the housing portion to move backward the nozzle piston to the movable end thereof by the first compression spring, when the fuel cartridge is further pushed in, the nozzle piston pushes in the ejection nozzle to open the opening/closing mechanism, whereby the fuel gas is ejected from the ejection nozzle and supplied to the coupling sleeve side. Thus, in the case where the cartridge is pushed and loaded in the housing portion, the opening/closing mechanism of the fuel cartridge is simultaneously opened, whereby the fuel gas is ejected from the ejection nozzle and supplied to the coupling sleeve side. Therefore, the fuel passage of the fuel gas from the ejection nozzle is secured and so the driving tool can be operated surely. Further, since the structure of the port portion of the fuel cartridge is simple, the cartridge can be attached to and detached from the driving tool easily and simply.

A tip end of the nozzle piston 62 in an axial direction of the nozzle piston may be closed. The nozzle piston 62 may include an introduction hole 67 extending in a direction intersecting said axial direction and formed near the tip end portion. Two seal members 65, 66 may be provided at an inner peripheral surface of the coupling sleeve 61 with an interval therebetween. When an ejection hole 17 of the ejection nozzle 4 extending in a direction intersecting said axial direction and the introduction hole 67 are located between the seal members 65, 66, the fuel gas may be supplied from the ejection hole 17 to the introduction hole 67.

According to the above structure, the tip end of the nozzle piston is closed, the introduction hole is formed at the side wall near the tip end portion, the ejection hole is formed at the side wall near the tip end portion of the ejection nozzle, two seal members are provided so as to have the interval therebetween at the inner peripheral surface of the coupling sleeve, and when the ejection hole and the introduction hole are located between these seal members, the fuel passage is formed from the fuel cartridge to the coupling sleeve side between the inner peripheral surface of the coupling sleeve and the outer peripheral surfaces of the tip ends of the nozzle piston and the ejection nozzle. Thus, the fuel gas can be supplied to the nozzle piston from the ejection nozzle.

A tip end of the nozzle piston 62 in an axial direction of the nozzle piston may be closed. Two seal members 65, 66 may be provided at an inner peripheral surface of the coupling sleeve 61 with an interval therebetween. An introduction hole 67 penetrating a side wall of the coupling sleeve 61 may be formed between the seal members 65, 66. When an ejection hole 17 of the ejection nozzle 4 extending in a direction intersecting said axial direction are located between the seal members 65, 66, the fuel gas may be supplied from the ejection hole 17 to the introduction hole 67.

According to the above structure, in place of the nozzle piston, the introduction hole is formed in a penetrated manner at the side wall of the coupling sleeve between the two seal members. Thus, the fuel passage is not limited to the coupling sleeve and may be designed freely.

The tool main body 34 may be provided with a fuel measuring device 50.

According to the above structure, the tool main body is provided with the fuel measuring device communicating with the fuel passage. Thus, since it is not necessary to provide the fuel measuring device at the fuel cartridge, the cost of the fuel cartridge can be reduced.

The cartridge main body 1 may be provided with an adaptor sleeve 18 at a periphery of the ejection nozzle 4. An inner plate 20 having a fitting hole 25 fitting to the ejection nozzle 4 may be slidably provided within the adaptor sleeve 18. The inner plate 20 may be biased in a direction of protruding toward an outside of the adaptor sleeve 18.

According to the above structure, when the fuel gas within the fuel cartridge is consumed completely, the housing portion is opened. Thus, the bias spring having been compressed by the inner plate is released and also both the first compression spring and the second compression spring are released, whereby the fuel cartridge is pushed out backward by the restoring force of these springs. As a result, the fuel cartridge can be detached easily.

A dust proof seal member 64 which contacts with the nozzle piston 62 in a standby state to prevent dust from entering from an end portion of the coupling sleeve 61 may be provided at an inner peripheral surface of the end portion of the coupling sleeve 61.

According to the above structure, the dust proof seal member, which contacts with the nozzle piston in the standby state to prevent dust from entering from the end portion of the coupling sleeve, is provided at the inner peripheral surface of the end portion of the coupling sleeve. Thus, even in a state the fuel cartridge is not coupled, dust is prevented from entering into the coupling sleeve. Further, even in a state where the fuel cartridge is coupled, since the seal member contacts with the ejection nozzle, dust can be effectively prevented from entering into the coupling sleeve from the outside.

Other aspects and advantages of the invention will be apparent from the following description, the drawings and the claims.

DESCRIPTION OF THE REFERENCE NUMERALS AND SIGNS

Figure 1:
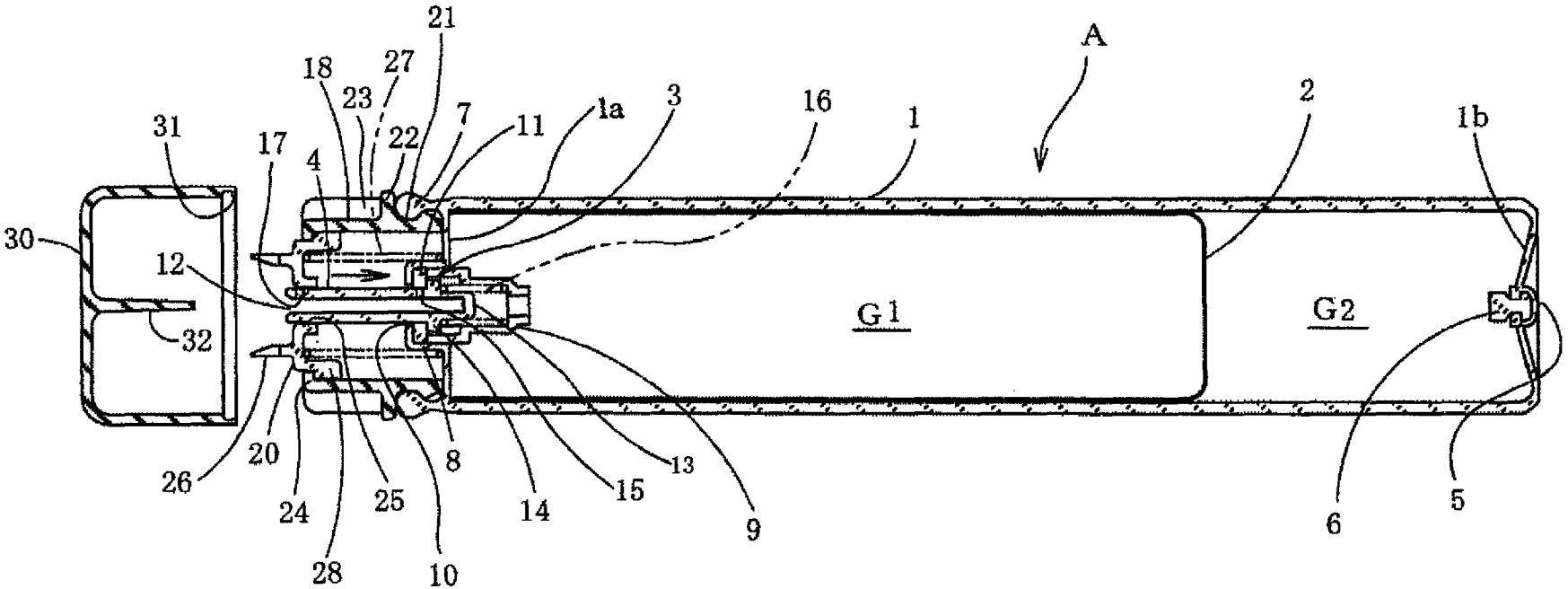
FIG. 1 is a longitudinal sectional diagram of a fuel cartridge according to an exemplary embodiment of the invention.

1 cartridge main body
3 opening/closing mechanism
4 ejection nozzle
16 first compression spring
17 supply hole
18 adaptor sleeve
20 inner plate
70 second compression spring

DETAILED DESCRIPTION OF THE EXEMPLARY EMBODIMENTS

Figure 2:
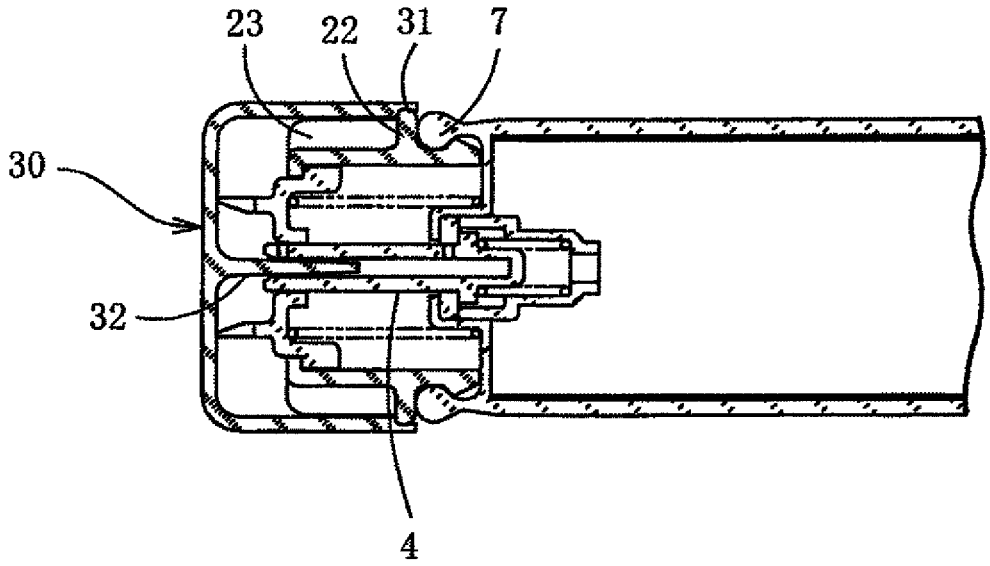
FIG. 2 is a longitudinal sectional diagram showing a state where the fuel cartridge is closed by a cap.

Exemplary embodiments of the invention is described in reference to drawings. In FIGS. 1 and 2, a sign A denotes a cartridge A. The cartridge A is provided so as to be freely attachable to and detachable from a gas-combustion type driving tool described later to thereby supply fuel gas to the striking mechanism of the tool main body. The fuel cartridge is configured by a cartridge main body 1, an inner bag 2 disposed within the cartridge main body 1 and an opening/closing mechanism 3 for ejecting fuel gas filled within the inner bag 2, etc.

Liquid fuel gas G1 is filled within the inner bag 2 and compressed gas G2 pressurized so as to be higher than the pressure of the liquid fuel gas G1 is filled in a space S between the cartridge main body and 1 and the inner bag 2. The compressed gas G2 acts to press the surface of the inner bag 2 to crush the inner bag 2 to thereby eject the liquid fuel gas G1 to the outside from an ejection nozzle 4. Normally propellant gas is filled as the compressed gas. In this manner, the pressure of the propellant gas within the cartridge 1 is set to be higher than the inner pressure of the inner bag 2 by two or three atmospheric pressures so that the inner bag 2 is pressed by the gas pressure of the propellant gas to thereby eject the fuel gas.

The cartridge main body 1 is configured by a cylindrical member made of aluminum and having a predetermined diameter, a predetermined length and a predetermined thickness. An end wall 1*a* for filling the liquid fuel gas is formed at the tip end opening portion of the cartridge main body. A bottom portion 1*b* is caved in a conical manner and an opening portion 5 for filling the compressed gas is formed at the center portion of the caved portion. The opening portion is closed by a rubber plug 6. In contrast, since the inner bag 2 is disposed within the cartridge main body 1, the inner bag has an outer shape similar to that of the cartridge main body 1 in a state that the gas to be filled therein is not yet filled. Further, the inner bag is smaller than the cartridge main body 1 and is formed by a cylindrical member having a bottom portion and formed by a thin aluminum etc. which is likely deformed.

Further, an annular expanded projection portion 7 is formed at the tip end portion of the cartridge main body 1. The end wall 1*a* is provided near the expanded projection portion. A short tubular portion 8 is formed at the center portion of the end wall 1*a* so as to protrude outward. The tip end of the short tubular portion 8 is bent inside so as to be have a small diameter and is provided with a port portion 10 having a diameter smaller than the inner diameter of the short tubular portion 8. At the inside of the short tubular portion 8, the opening/closing mechanism 3 for opening/closing the inner bag 2 and the ejection nozzle 4 is provided by a seal portion 11 and the ejection nozzle 4.

The seal portion 11 is formed by composite resin in an annular shape and fixed to the bottom portion of the short tubular portion 8. The ejection nozzle 4 is provided at the port 10 so as to be slidable freely. The ejection nozzle 4 is also made by composite resin. An end portion 12 on the outer side of the ejection nozzle is opened and an end portion 13 on the inner side of the ejection nozzle is closed. A spring receiving seat 14 is formed near the end portion 13 on the inner side of the ejection nozzle 4. A hole 15 is formed in a penetrated manner on the end portion side of the spring receiving seat 14. 9 denotes a spring bearing. A first compression spring 16 is disposed between the spring bearing 9 and the hole 15, whereby the ejection nozzle 4 is always biased so as to protrude outward. When the ejection nozzle 4 is in a standby state, the hole 15 is closed by the seal portion 11. When the ejection nozzle 4 is pushed inside as shown by an arrow in FIG. 3 against the first compression spring 16, since the hole 15 moves away from the seal portion 11, the opening/closing mechanism 3 is opened.

A supply hole 17 for ejecting the fuel gas within the ejection nozzle 4 to the outside is formed in a penetrated manner near the end portion on the outer side of the ejection nozzle 4.

Further, an adaptor sleeve 18 is attached to the tip end portion of the cartridge main body 1 and an inner plate 20 is provided at the tip end of the adaptor sleeve 18 so as to be slidable freely.

The adaptor sleeve 18 is formed by composite resin in a tubular shape. An annular recess portion 21 is formed at the outer peripheral surface of the base portion of the adapter sleeve so as to be able to fit to the inside of the expanded projection portion 7 at the tip end of the cartridge main body 1. Thus, the adaptor sleeve 18 can be attached by being strongly pushed into the inside of the portion of the cartridge main body 1. Further, a flange portion 22 is formed near the annular recess portion 21 and a plurality of ribs 23 are formed with an interval thereamong on the outer side of the flange portion 22. A diameter of a circle formed by coupling the outer side surfaces of these ribs 23 is formed so as to be almost same as the diameter of the cartridge main body 1. Furthermore, an engagement edge 24 having an end portion bent inside so as to have a small diameter is formed at the tip end of the adaptor sleeve 18. The tip end of the ejection nozzle 4 is provided so as to protrude outward than the opening end of the adaptor sleeve 18.

The inner plate 20 is fit to the inside of the adaptor sleeve 18 so as to be slidable freely and is provided with a fitting hole 25 for the ejection nozzle 4 at the center portion thereof. Further, guide projections (guide portions) 26 are provided at the outer side of the fitting hole 25 in an annular manner with an interval thereamong. In the standby mode, the inner plate 20 engages with the engagement edge 24 of the adaptor sleeve 18 in a manner that a protrusion edge 28 formed at the outer peripheral end of the inner plate engages with the engagement edge of the adaptor sleeve by a bias spring 27 provided between the inner plate and the end wall 1*a* of the port portion of the cartridge main body 1.

The ejection nozzle 4, the first compression spring 16, the bias spring 27, the inner plate 20 and the adaptor sleeve 18 are disposed on the same axis.

Further, a cap 30 is provided at the adaptor sleeve 18 so as to be detachable freely. The cap 30 acts to cover the inner plate 20 and the ejection nozzle 4 to thereby protect these members from an external force and dust and prevent the fuel gas from being erroneously ejected. The inner diameter of the cap 30 is set so as to be slightly larger than the outer diameter of the bottom portion of the fuel cartridge A. An engagement groove 31 capable of engaging with the flange portion 22 of the adaptor sleeve 18 is formed at the inner peripheral surface of the opening end portion of the cap 30. A needle portion 32 capable of being inserted inside of the ejection nozzle 4 from the tip end thereof is formed at the center portion of the inside of the cap 30.

According to the aforesaid configuration of the fuel cartridge, the ejection nozzle 4 is provided so as to be slidable freely at the port portion formed at the end portion of the cartridge main body 1, the first compression spring 16 biases the ejection nozzle so that the tip end of the ejection nozzle 4 always protrudes from the cartridge main body 1, the valve body is disposed at the port portion, and the opening/closing mechanism 3 is operated to be opened when the ejection nozzle 4 is slid against the biasing force of the spring. In this manner, since the fuel cartridge is configured in a manner that when the fuel cartridge is attached to the tool main body of the gas-combustion type driving tool, the ejection nozzle 4 is slid against the biasing force of the first compression spring 16, the fuel gas within the fuel cartridge A can be supplied to the tool main body simultaneously with the attachment of the fuel cartridge A.

Further, since the cartridge main body 1 is provided with the adaptor sleeve 18 at the outer periphery of the ejection nozzle 4, the ejection nozzle 4 can be protected from the external force applied from the periphery.

Figure 3:
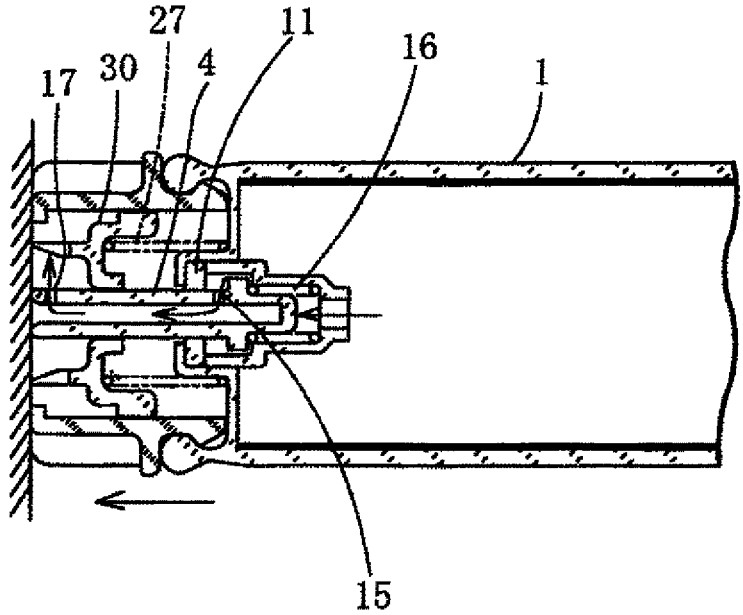
FIG. 3 is a sectional diagram of a main portion showing a mode of exhausting remaining fuel gas.

Further, the tip end of the ejection nozzle 4 is provided so as to protrude outward than the opening end of the adaptor sleeve 18. Thus, when the tip end of the ejection nozzle 4 is pushed against a suitable member, since the ejection nozzle 4 is pushed in by a length corresponding to the protruded length from the adaptor sleeve 18, the opening/closing mechanism 3 can be opened, whereby the fuel gas remained within the inner bag can be exhausted from the supply hole 17 of the ejection nozzle 4. Since the supply hole 17 is formed so as to penetrate the side wall of the tip end portion of the ejection nozzle 4, as shown in FIG. 3, since the supply hole 17 is not closed when the tip end of the nozzle is pushed against a floor etc., the remaining gas can be exhausted efficiently.

Figure 4:
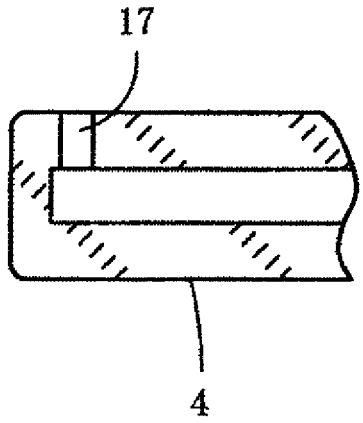
FIG. 4 is a longitudinal sectional diagram showing another mode of the opening portion of the end portion of an ejection nozzle.
Figure 5A:
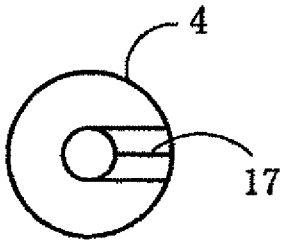
FIGS. 5(*a*), 5(*b*) and 5(*c*) show longitudinal sectional diagrams of still another mode of the ejection nozzle.
Figure 5B:
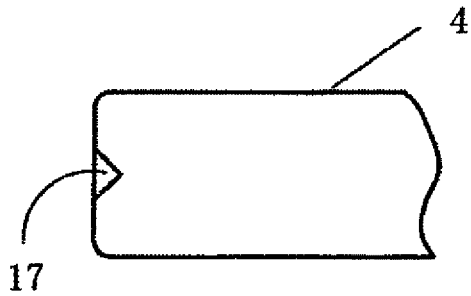
Figure 5C:
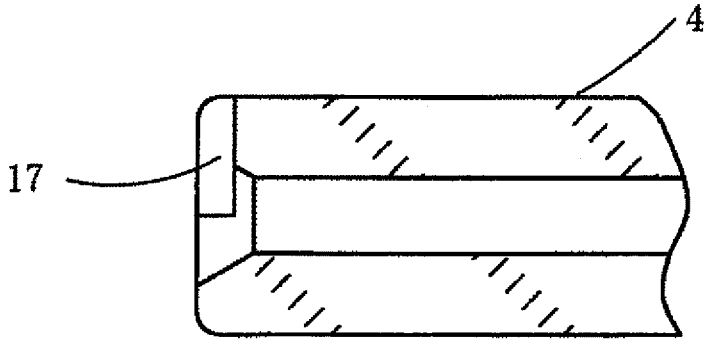

In this manner, the supply hole 17 of the ejection nozzle 4 is sufficient so long as it has a structure capable of exhausting the fuel gas at the side direction of the ejection nozzle 4. Thus, the tip end of the supply hole may be closed as shown in FIG. 4 or the supply hole may be formed in a groove shape as shown in FIGS. 5(*a*), 5(*b*) and 5(*c*).

Further, since the inner plate 20 having the fitting hole 25 fitting with the ejection nozzle 4 is provided at the opening end of the adaptor sleeve 18, the ejection nozzle 4 can be held stably. Further, the seal portion 11 of the opening/closing mechanism 3 of the ejection nozzle 4 can be protected from the outside and also the adhesion of dust can be prevented. Furthermore, since the inner plate 20 is provided so as to be slidable freely, the inner plate can be slid together with the ejection nozzle 4, so that the opening/closing operation of the opening/closing mechanism 3 is not interfered.

Sine the inner plate 20 is equipped with the guide portion 26 for guiding the coupling portion provided at the driving tool to the ejection nozzle 4, the ejection nozzle 4 can be correspondingly disposed at the predetermined position of the coupling portion.

Since the first compression spring 16, the bias spring 27, the inner plate 20 and the adaptor sleeve 18 are disposed on the coaxial line of the ejection nozzle 4, the sliding of each of the ejection nozzle 4 and the inner plate 20 and the expansion/compression of each of the first compression spring 16 and the bias spring 27 are directed in the same direction, whereby the entire mechanism can be configured simply.

Figure 6:
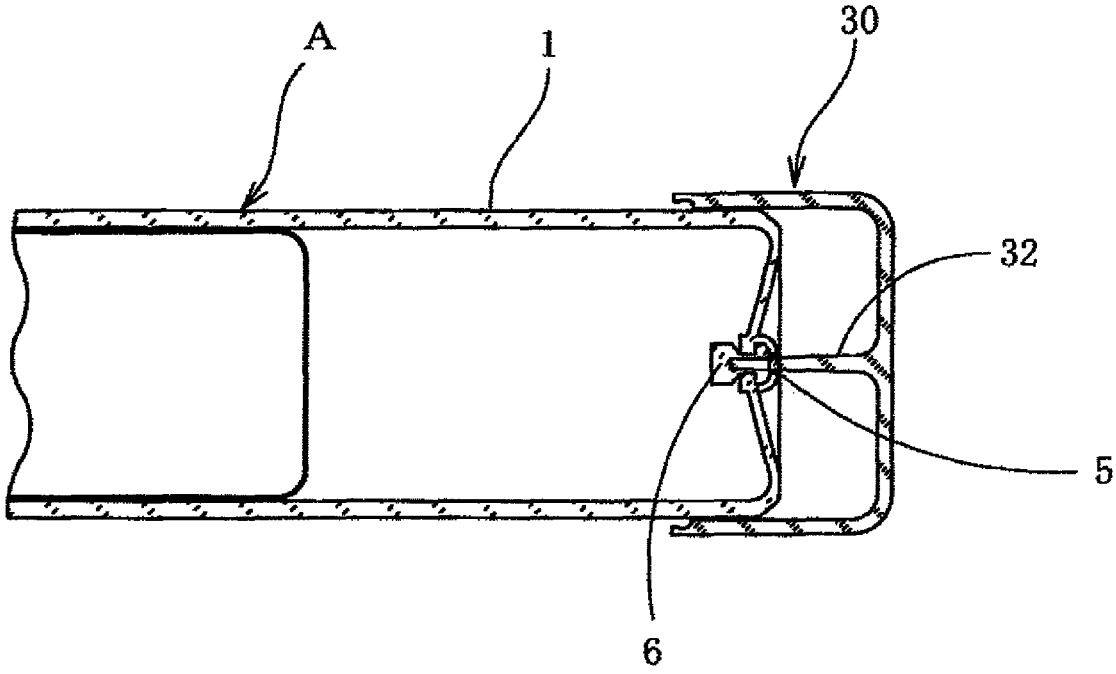
FIG. 6 is an explanatory diagram of an exhaust mode of compressed gas.

Further, the cap 30 for covering the inner plate 20 and the ejection nozzle 4 is provided at the adaptor sleeve 18 so as to be detachable freely. The needle portion 32 capable of being inserted inside of the ejection nozzle 4 from the tip end thereof is formed at the center portion of the inside of the cap 30 and the inner diameter of the cap 30 is formed so as to be slightly larger than the outer diameter of the bottom portion of the fuel cartridge A, the cartridge can be protected from the external force and the dust and the fuel gas is prevented from being ejected erroneously. Further, since the needle portion 32 is inserted into the ejection nozzle 4, the ejection nozzle 4 can be held in the stable state. Furthermore, in the case of exchanging the fuel cartridge A, as shown in FIG. 6, the cap 30 of a new fuel cartridge A is strongly pushed into and fit to the bottom portion of the cartridge main body 1 of the old fuel cartridge A, whereby the needle portion 32 at the center portion breaks through the bottom portion of the old fuel cartridge A to exhaust the compressed gas contained therein. Thus, the spent fuel cartridge A can be disposed safely.

Next, the explanation will be made as to a mechanism for attaching the fuel cartridge A to the gas-combustion type driving tool.

Figure 7:
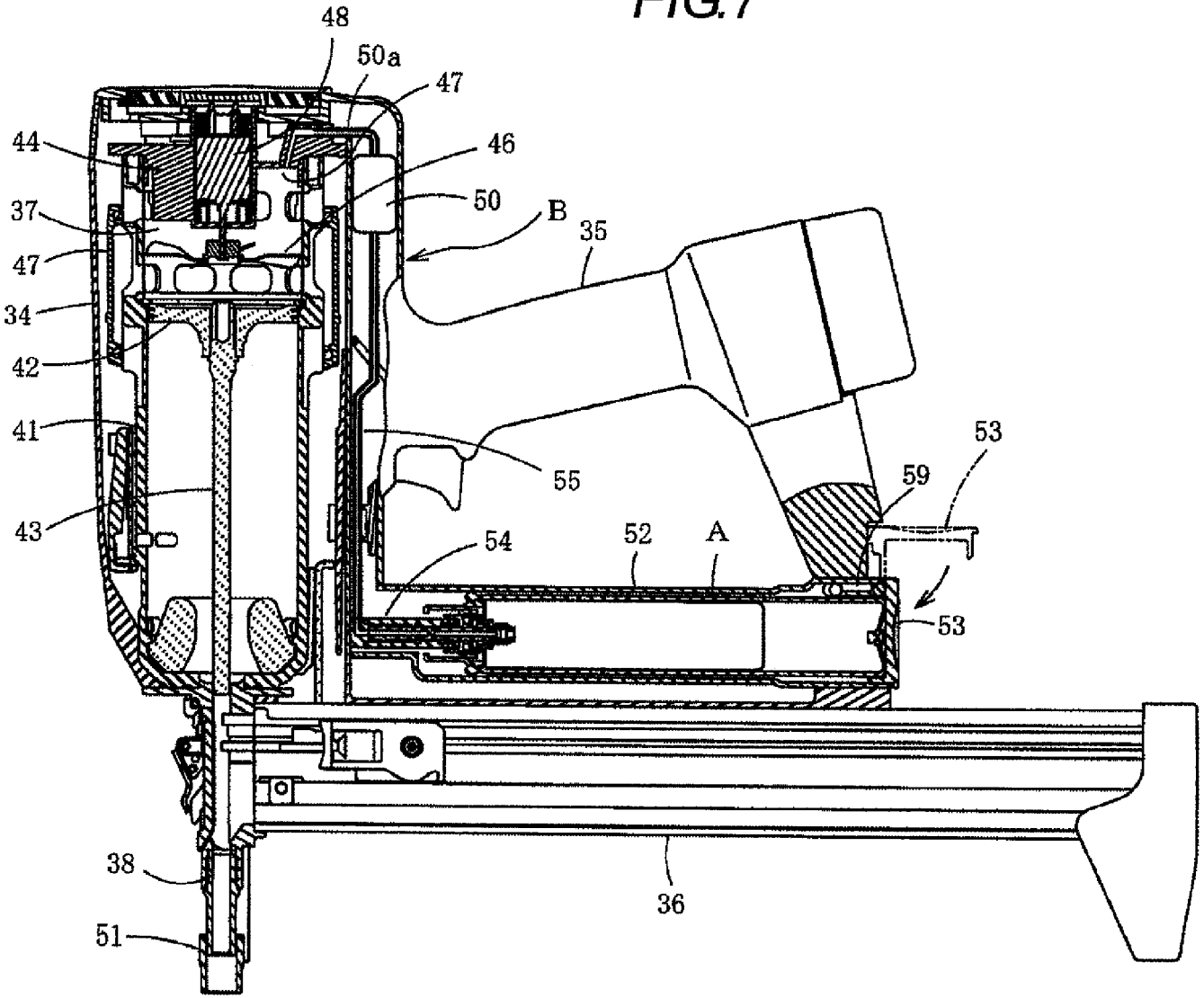
FIG. 7 is a sectional diagram of a main portion showing a state where the fuel cartridge is loaded in a gas-combustion type driving tool.

In FIG. 7, a sign B shows the driving tool (nailing machine) and 34 denotes the tool main body. A grip 35 and a magazine 36 are coupled to the tool main body 34, and a combustion chamber 37 and a striking mechanism are provided within the tool main body. A nose portion 38 for driving a nail out is provided beneath the tool main body 34, and the magazine 36 for supplying nails is coupled to the nose portion 38.

The striking mechanism is configured in a manner that a striking piston 42 is housed within a striking cylinder 41 so as to be slidable freely and a driver 43 is integrally coupled to the striking piston 42 so as to extend beneath the piston.

A cylinder head portion 44 is provided with an ignition plug (not shown), a rotary fan 46 and a fuel injection nozzle 45. The ignition plug ignites mixed gas of the fuel gas and the air within the combustion chamber 37 to combust the mixed gas. The rotary fan 46 acts to stir and mix the fuel gas and the air and is disposed at the center of a movable sleeve 47.

48 denotes a motor for driving the rotary fan 46.

The movable sleeve 47 constituting the combustion chamber 37 is disposed at the outer upper portion of the striking cylinder 41. The movable sleeve 47 is configured in a cylindrical shape and is disposed between the striking cylinder 41 and the cylinder head portion 44 formed within the upper housing so as to be slidable elevationally. The combustion chamber 37 in a sealed state is formed within the movable sleeve 47 when the movable sleeve moves upward, whilst the combustion chamber 37 is opened when the movable sleeve moves downward.

The movable sleeve 47 is coupled via a not-shown link member with a contact member 51 provided at the tip end of the nose portion 38 so as to be slidable freely. The contact member 51 is biased by a spring so as to protrude from the tip end of the nose portion 38. Thus, when the nose portion 38 is pressed against the material to be struck, since the contact member 51 is pushed in and moves upward, the movable sleeve 47 also moves upward via the link member to thereby constitute the sealed combustion chamber 37. In contrast, when the nose portion 38 is separated from the material to be struck, since the contact member 51 moves to the original position, the movable sleeve 47 also moves downward to thereby open the combustion chamber 37.

Thus, when the fuel gas is supplied to the combustion chamber 37 in the sealed state from the fuel measuring device described later and the mixed gas of the fuel gas and the air is stirred and ignited to combust the mixed gas, the striking piston of the striking mechanism is driven, whereby a nail supplied within the nose portion 38 is driven out.

Next, a housing portion 52 capable of loading the fuel cartridge A therein is formed at the upper portion of the magazine 36. The housing portion 52 is formed in a cylindrical shape.

A lock member 53 is provided at the rear end portion of the housing portion and a coupling portion 54 to be coupled with the fuel cartridge A is provided at the front end side of the housing portion. Further, the coupling portion 54 is coupled via a fuel supply tube 55 to a fuel measuring device 50 provided at the upper portion of the tool main body 34. The fuel measuring device 50 supplies a constant amount of the fuel gas to the fuel injection nozzle 45 via another fuel supply tube 50*a*. A known fuel measuring device may be employed.

Figure 8:
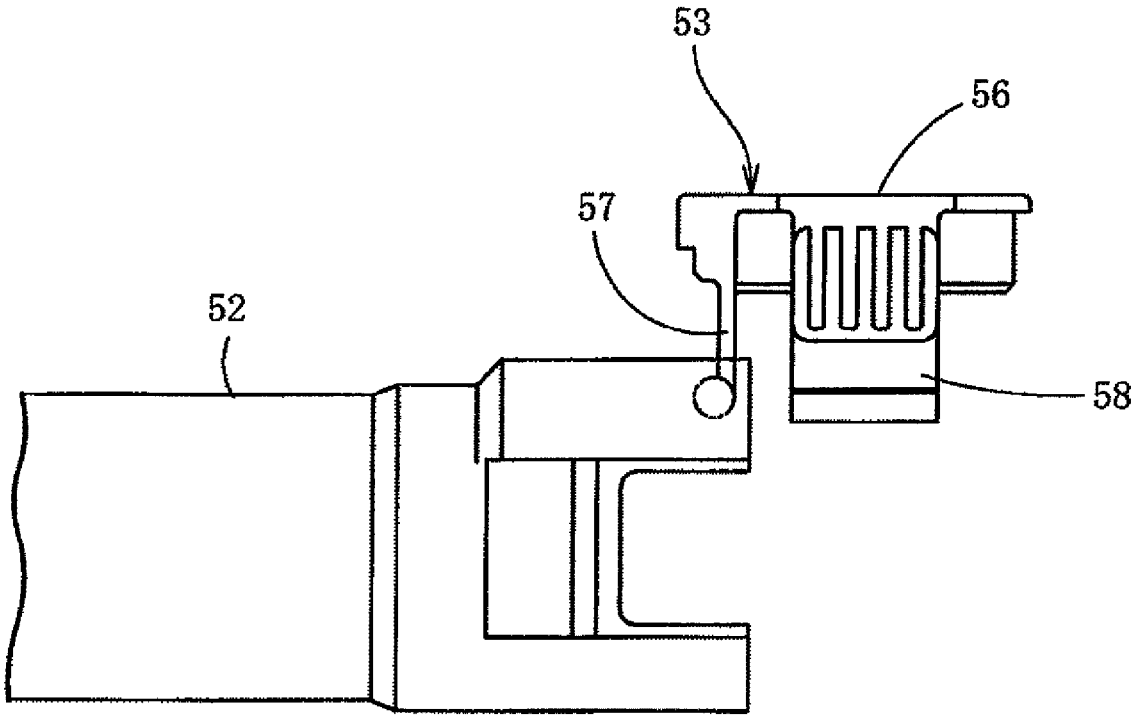
FIG. 8 is a side view showing a housing portion and a lock member.
Figure 9:
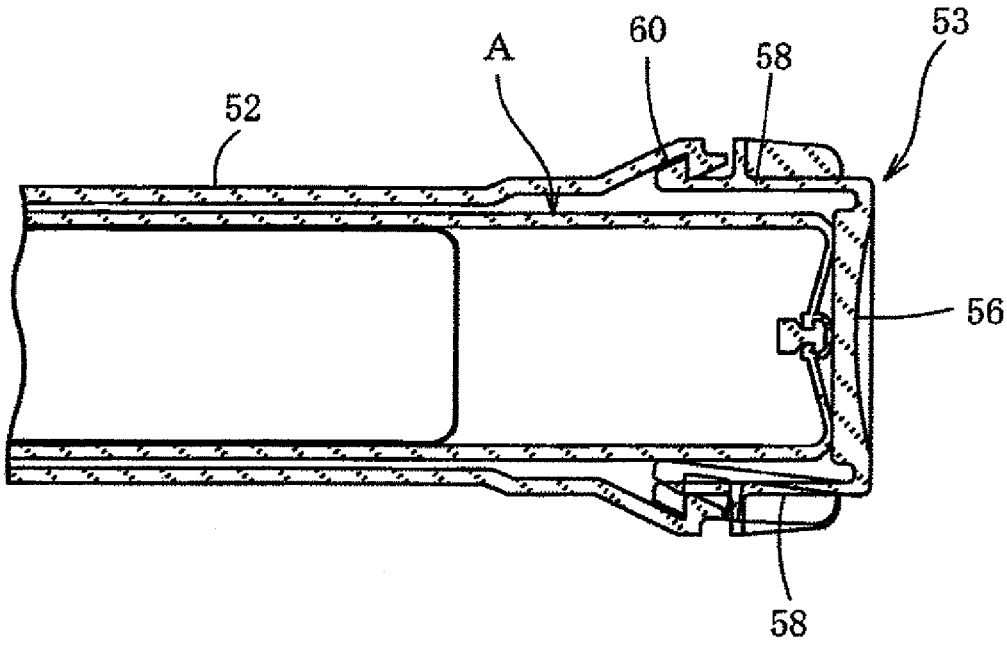
FIG. 9 is a sectional diagram showing a state where a locking operation is performed as to a lock member.

As shown in FIGS. 7 to 9, the lock member 53 is configured in a manner that a coupling piece 57 is formed so as to have a size capable of closing the rear end of the housing portion 52 and be coupled to the housing portion 52 from a part of a plate member 56, engagement projection pieces 58 are protrusively formed at the both sides of the coupling piece 57, and the coupling piece 57 is coupled to a long hole 59 formed at the rear end portion of the housing portion 52 so as to be able to open/close the hole and also so as to be slidable.

The engagement projection pieces 58 are formed so as to be able to elastically engage with engagement grooves 60 formed at the both side portions of the rear end of the housing portion 52, respectively.

Figure 10:
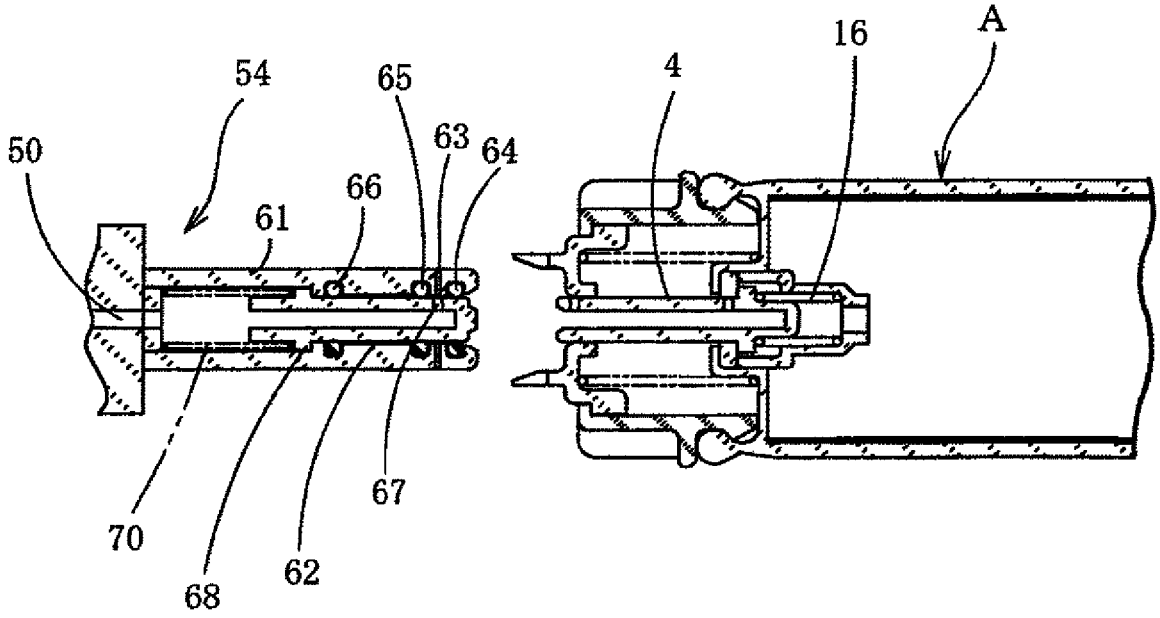
FIG. 10 is a sectional diagram showing a state just before attaching the fuel cartridge to a coupling portion.

Next, as shown in FIG. 10, the coupling portion 54 is provided with a coupling sleeve 61 which rear end is opened to the fuel supply tube 55. A nozzle piston 62 is housed within the coupling sleeve 61 so as to be slidable freely. The coupling sleeve 61 is configured to have a size capable of being fit into the guide projection 26 of the inner plate 20 of the fuel cartridge A and is provided with an exhaust hole 63 at the tip end thereof. A first seal member 64 is provided on the inner peripheral surface of the coupling sleeve 61 between the tip end thereof and the exhaust hole 63. Further, a second seal member 65 and a third seal member 66 are provided with a certain space therebetween between the base portion of the coupling sleeve and the exhaust hole 63.

The nozzle piston 62 is configured in a manner that the shape thereof is a cylindrical shape having the same diameter as the ejection nozzle 4, the tip end thereof is closed, the rear end is opened, and an introduction hole 67 for the fuel gas is formed at the side wall near the tip end portion thereof.

An annular projection edge 68 is formed at the rear portion of the nozzle piston 62. The nozzle piston 62 is always biased by a second compression spring 70 disposed between the projection edge 68 and the bottom portion of the coupling sleeve 61 so as to locate near the tip end portion of the coupling sleeve 61 or protrude therefrom. The biasing force of the second compression spring 70is smaller than the first compression spring 16 for biasing the ejection nozzle 4 within the fuel cartridge A.

When the nozzle piston is in the standby state, since the introduction hole 67 locates at the position matching with the exhaust hole 63 of the coupling sleeve 61, the fuel gas remained within the fuel supply tube 55 of the tool main body 34 is emitted to the atmosphere from the exhaust hole 63.

The ejection nozzle 4 and the nozzle piston 62 are configured so as to be aligned almost coaxially when the fuel cartridge A is loaded into the housing portion 52.

Figure 11:
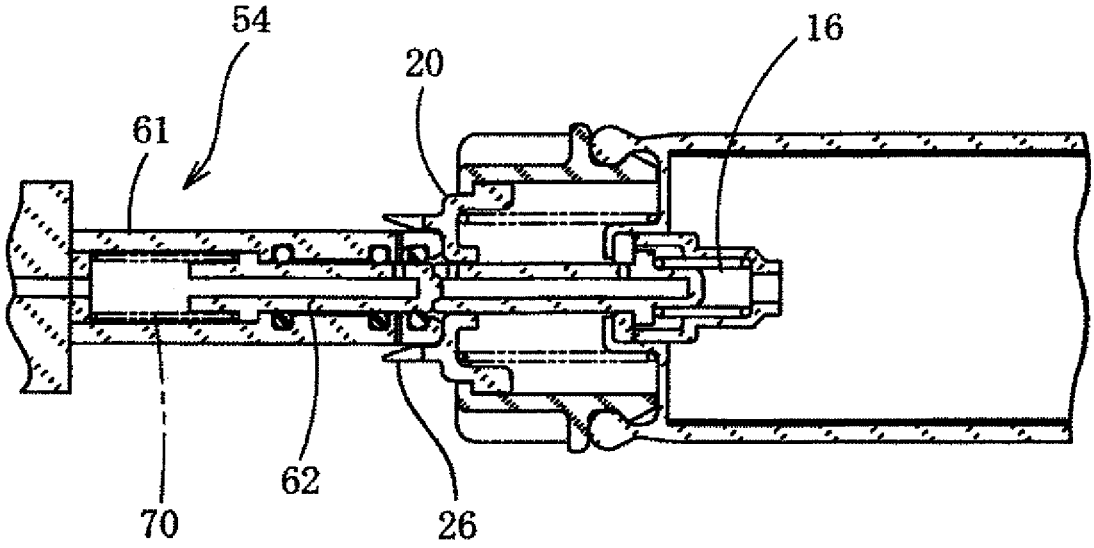
FIG. 11 is a sectional diagram showing a state where the tip end of the fuel cartridge abuts against the coupling portion.
Figure 12:
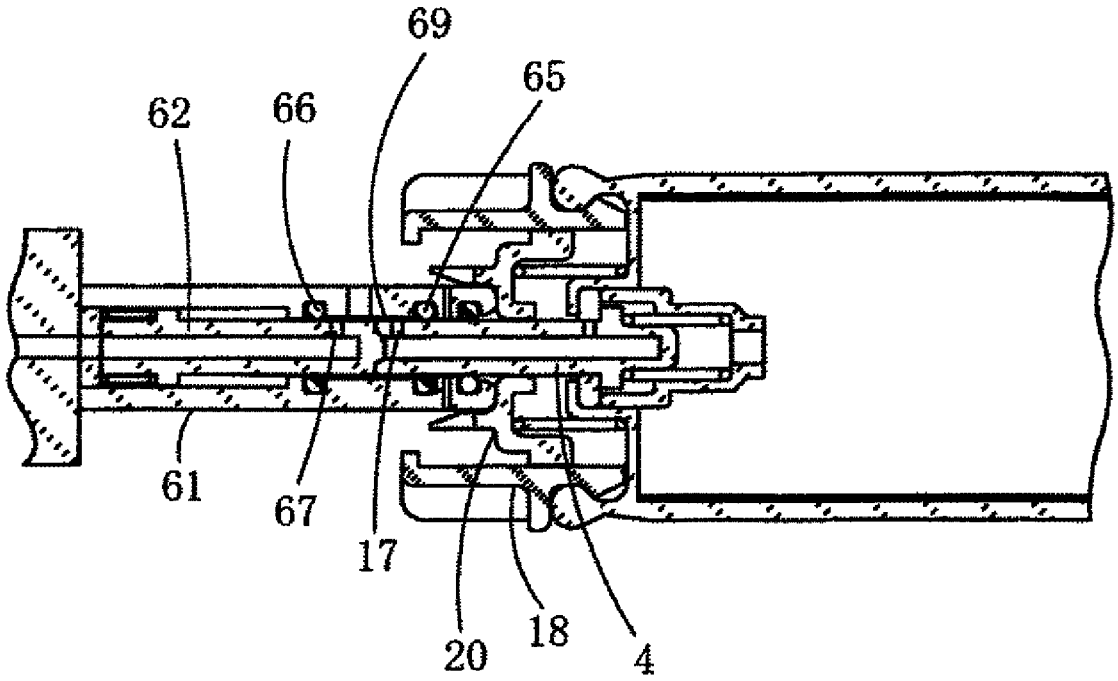
FIG. 12 is a sectional diagram showing a state where a fuel passage is formed on the way of pressing the fuel cartridge against the coupling portion.

In the aforesaid configurations when the fuel cartridge A from which the cap 30 is detached is inserted and pushed into the rear end of the housing portion 52, as shown in FIG. 11, the coupling sleeve 61 is guided along and fit into the inner side of the projections 26 of the inner plate 20, whereby the tip end of the ejection nozzle 4 abuts against the nozzle piston 62. The biasing force of the first compression spring 16 for biasing the ejection nozzle 4 is larger than the biasing force of the second compression spring 70 for biasing the nozzle piston 62. Thus, as shown in FIG. 12, since the nozzle piston 62 is pushed in against the second compression spring 70 as the fuel cartridge A is pushed in, the ejection nozzle 4 proceeds into the coupling sleeve from the opening end of the coupling sleeve 61 and finally the nozzle piston 62 abuts against the bottom portion of the coupling sleeve 61. In this case, since the supply hole 17 of the ejection nozzle 4 and the induction hole 67 of the nozzle piston 62 are located between the second seal member 65 and the third seal member 66 of the coupling plate, a fuel passage 69 communicating with the fuel measuring device 50 is formed between the inner peripheral surface of the coupling sleeve 61 and the outer peripheral surfaces of the tip ends of the nozzle piston 62 and the ejection nozzle 4. The inner plate 20 is also pushed into the inside of the adaptor sleeve 18.

Figure 13:
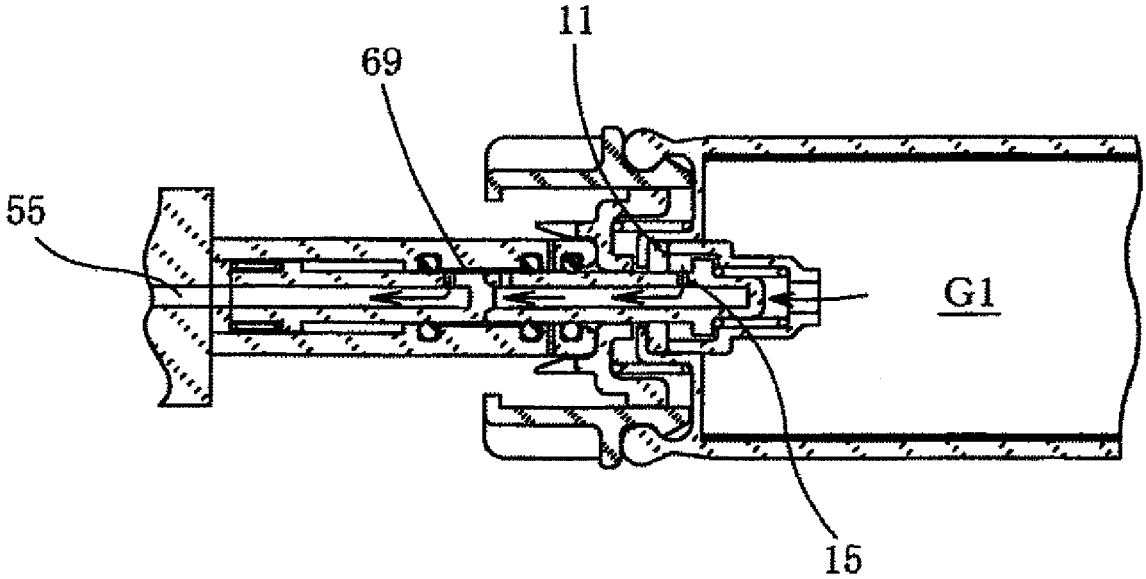
FIG. 13 is a sectional diagram showing a state where the fuel cartridge is further pushed to communicate the fuel cartridge with a fuel supply tube.

Further, when the fuel cartridge A is pushed in completely, as shown in FIG. 13, since the nozzle piston 62 is not pushed in any more, the ejection nozzle 4 is pushed in against the first compression spring 16 and moves backward. Thus, since the hole 15 of the ejection nozzle 4 is separated from the inner surface of the annular portion of the seal portion 11, the opening/closing mechanism 3 opens. As a result, the fuel within the inner bag 2 is supplied to the fuel measuring device 50 from the hole 15 via the inner space of the ejection nozzle 4, the supply hole 17, the fuel passage, the inner space of the nozzle piston 62 and the fuel supply tube 55.

After sufficiently pushing the fuel cartridge A into the housing potion 52, as shown in FIG. 7, the lock member 53 is rotated to elastically engage the engagement piece thereof with the engagement grooves 60 of the housing portion 52. As a result, the fuel cartridge A is always held in a state of supplying the fuel gas to the fuel measuring device 5.

When the fuel gas within the fuel cartridge A is consumed completely, the lock member 53 is rotated downward to release the engagement state to thereby open the housing portion 52. Thus, since the inner plate 20 is pushed in, the bias spring 27 having been compressed is released and also both the first compression spring 16 and the second compression spring 70 are released, whereby the fuel cartridge A is pushed out backward by the restoring force of these springs. As a result, the fuel cartridge A can be detached easily. The sum of the spring load of the bias spring 27 of the inner plate 20 and the spring load of the second compression spring 70 is set to be larger than the sliding resistance value between the ejection nozzle 4 and the seal members 64 and 65 of the coupling sleeve 61.

In the case of exchanging the fuel cartridge A, the cap 30 of a new fuel cartridge A is strongly pushed into and fit to the bottom portion of the old fuel cartridge A, whereby the needle portion 32 at the center portion breaks through the bottom portion of the old fuel cartridge A to exhaust the compressed gas contained therein. Thus, the spent fuel cartridge can be disposed safely.

According to the aforesaid configuration, the opening/closing mechanism 3 of the fuel cartridge A can be opened simultaneously with the pushing and loading of the fuel cartridge A into the housing portion 52, then the fuel gas can be ejected from the ejection nozzle 4 and supplied to the coupling sleeve 61, and further the fuel gas can always be supplied to the fuel measuring device 50 from the coupling sleeve 61. Thus, a predetermined amount of the fuel gas measured by the fuel measuring device 50 is supplied to the combustion chamber, then ignited and combusted, whereby the striking mechanism is driven.

Further, the tip end of the nozzle piston 62 is closed to form the introduction hole 67 at the side wall near the tip end portion, and the supply hole 17 is formed at the side wall near the tip end portion of the ejection nozzle 4. Further, the second and third seal members 65, 66 are provided at the inner peripheral surface of the coupling sleeve 61 with the interval therebetween. When the supply hole 17 and the introduction hole 67 are located between these seal members 65, 66, the fuel passage is formed from the fuel cartridge A to the coupling sleeve 61 side between the inner peripheral surface of the coupling sleeve 61 and the outer peripheral surfaces of the tip ends of the nozzle piston 62 and the ejection nozzle 4, whereby the fuel gas can be supplied to the nozzle piston 62 from the ejection nozzle 4.

Furthermore, since the fuel measuring device 50 communicating with the fuel passage is provided at the tool main body 34, it is not necessary to the fuel measuring device 50 at the fuel cartridge A, so that the cost of the fuel cartridge A can be reduced.

Further, since the first seal member 64, which contacts with the nozzle piston 62 in the standby mode to prevent dust from entering from the end portion, is provided at the inner peripheral surface of the opening end portion of the coupling sleeve 61, dust can be prevented from entering into the coupling sleeve 61 even in the state that the fuel cartridge A is not coupled. Furthermore, even in the state that the fuel cartridge A is coupled, since the first seal member 64 contacts with the ejection nozzle 4, dust from the outside can be effectively prevented from entering.

Figure 14:
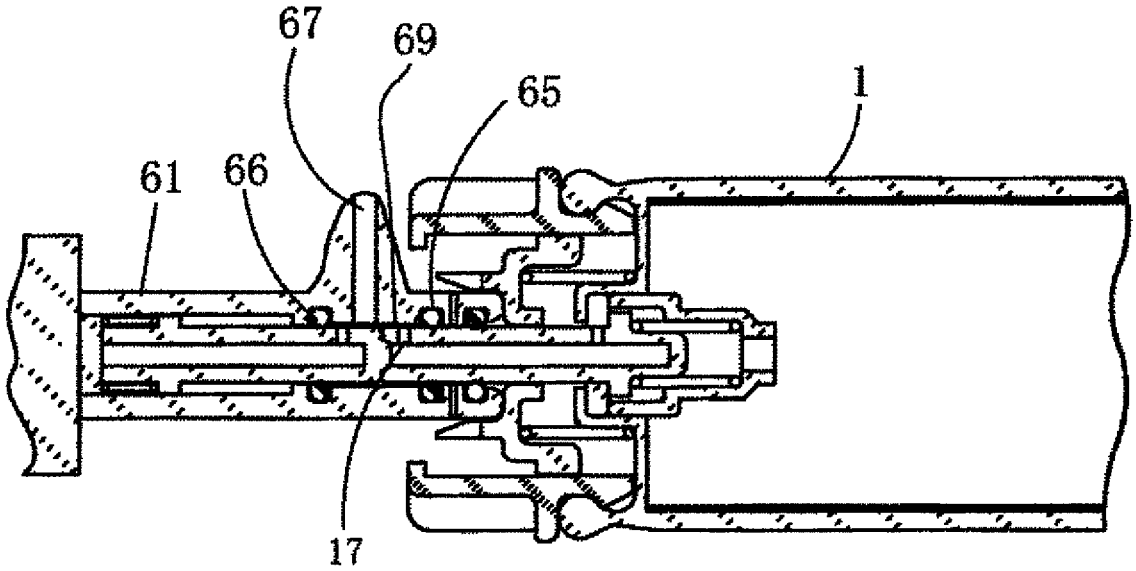
FIG. 14 is a sectional diagram showing an another mode of the fuel passage.

In place of the nozzle piston 62, as shown in FIG. 14, the introduction hole 67 may be formed at the side wall of the coupling sleeve 61 between the two seal members 65 and 66. According to this configuration, the fuel passage 69 is not limited to the coupling sleeve 61and may be designed freely.

Figure 15:
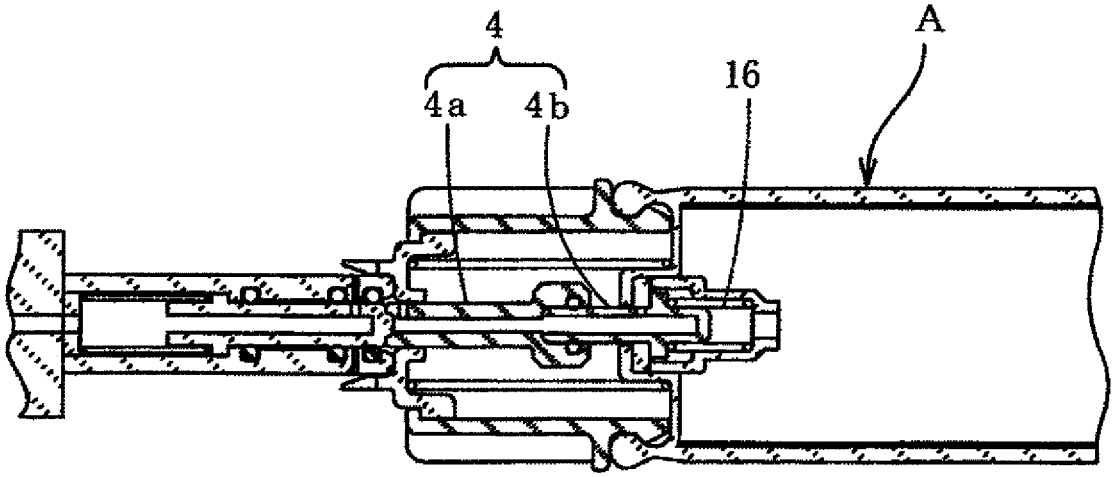
FIG. 15 is a sectional diagram showing an another mode of the ejection nozzle.

Further, the ejection nozzle 4 may not be formed integrally. As shown in FIG. 15, the ejection nozzle 4 may be configured by serially coupling a first ejection nozzle 4*a* and a second ejection nozzle 4*b*. According to this configuration, when the first ejection nozzle 4*a* is short, the stroke of the first compression spring 16 can be secured additionally by an amount corresponding to the shortage of the first ejection nozzle.

Figure 16:
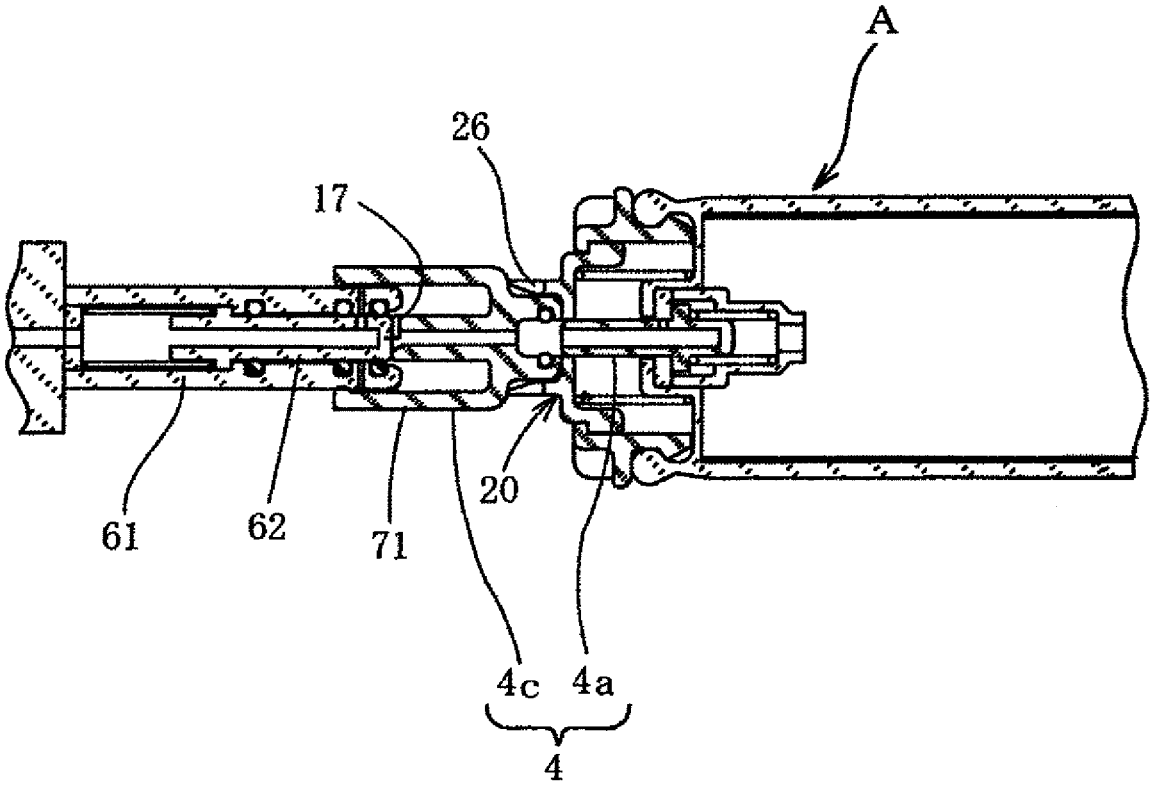
FIG. 16 is a sectional diagram showing a mode where the part of the ejection nozzle is provided on a coupling sleeve side.

Further, as shown in FIG. 16, the ejection nozzle 4 may be configured by the first ejection nozzle 4*a* on the inner side and an auxiliary ejection nozzle 4*c* on the outer side in a manner that the auxiliary ejection nozzle 4*c* is provided at the coupling sleeve 61 so as to slidable freely. An outer tube 71 freely fitting to the outside of the coupling sleeve 61 is integrally formed on the outside of the auxiliary ejection nozzle 4*c*. The supply hole 17 is formed at the side wall of the end portion on the nozzle piston 62 side of the auxiliary ejection nozzle 4*c* and the other portion of the auxiliary ejection nozzle is formed so as to be able to fit to the guide projection 26 of the inner plate 20.

Also according to the aforesaid configuration, when the fuel cartridge A is loaded, after the second ejection nozzle 4*b* pushes in the nozzle piston 62 together with the first ejection nozzle 4*a*, the nozzle piston 62 pushes back to open the opening/closing mechanism 3, whereby the ejection nozzle 4 can supply the fuel gas to the fuel passage. The second ejection nozzle 4*b* can reduce shock caused at the time of loading the fuel cartridge A.

While description has been made in connection with specific exemplary embodiment of the invention, it will be obvious to those skilled in the art that various changes and modification may be made therein without departing from the present invention. It is aimed, therefore, to cover in the appended claims all such changes and modifications falling within the true spirit and scope of the present invention.

What is claimed is:

1. A fuel cartridge, which is capable of being mounted on a tool main body of a gas-combustion type driving tool so as to supply fuel gas to a striking mechanism of the tool main body, the fuel cartridge comprising:

an ejection nozzle provided at a port portion formed at an end portion of a cartridge main body and slidable with respect to the cartridge main body;

a compression spring for biasing the ejection nozzle so that a tip end of the ejection nozzle protrudes from the cartridge main body;

an adaptor sleeve provided at a periphery of the ejection nozzle; and an inner plate slidable within the adaptor sleeve and having a fitting hold which fits with the ejection nozzle, wherein the inner plate is biased in a direction of protruding to an outside of the adaptor sleeve, wherein the inner plate is biased so as to protrude outward toward an opening end of the adaptor sleeve.

2. A fuel cartridge which is capable of being mounted on a tool main body of a gas-combustion type driving tool so as to supply fuel gas to a striking mechanism of the tool main body, the fuel cartridge comprising:

an ejection nozzle provided at a port portion formed at an end portion of a cartridge main body and slidable with respect to the cartridge main body;

a compression spring for biasing the ejection nozzle so that a tip end of the ejection nozzle protrudes from the cartridge main body;

an ejection hole formed in a side wall of the ejection nozzle at a leading end side of the ejection nozzle; and a base side hole formed in the side wall of the ejection nozzle at a base end side of the ejection nozzle which is opposite side of the leading end side, wherein the compression spring biases the ejection nozzle in an axial direction of the ejection nozzle, and wherein a direction in which the ejection hole extends intersects with the axial direction of the ejection nozzle.

3. The fuel cartridge according to claim 2, further comprising a valve disposed at the port portion, wherein the valve opens when the ejection nozzle slides against a biasing force of the spring.

4. The fuel cartridge according to claim 2, further comprising an adaptor sleeve provided at a periphery of the ejection nozzle.

5. The fuel cartridge according to claim 4, wherein a tip end of the ejection nozzle protrudes outward from an opening end of the adaptor sleeve.

6. The fuel cartridge according to claim 4, further comprising an inner plate slidable within the adaptor sleeve and having a fitting hole which fits with the ejection nozzle, wherein the inner plate is biased in a direction of protruding to an outside of the adaptor sleeve.

7. The fuel cartridge according to claim 6, further comprising a guide portion provided on the inner plate and for guiding a coupling portion in the tool main body to the ejection nozzle.

8. The fuel cartridge according to claim 6, wherein the compression spring, the inner plate and the adaptor sleeve are disposed coaxially with the ejection nozzle.

9. The fuel cartridge according to claim 6, further comprising a cap for covering the inner plate and the ejection nozzle and detachably attached to the adaptor sleeve, wherein the cap includes a needle portion capable of being inserted inside of the ejection nozzle from a tip end of the ejection nozzle at a center portion of an inside of the cap, and an inner diameter of the cap is slightly larger than an outer diameter of a bottom portion of the fuel cartridge.

10. A gas-combustion type driving tool comprising, a housing portion capable of loading a fuel cartridge from one end of the housing portion, the fuel cartridge including an ejection nozzle biased by a first compression spring and fuel gas being ejected when the ejection nozzle is pushed with respect to a cartridge main body against a biasing force of the first compression spring;

a coupling sleeve provided at an other end of the housing portion and capable of inserting the ejection nozzle of the fuel cartridge therein;

a nozzle piston slidably housed within the coupling sleeve and capable of abutting a tip end of the ejection nozzle; and a second compression spring for biasing the nozzle piston to a tip end portion side of the coupling sleeve, wherein a biasing force of the second compression spring is smaller than the biasing force of the first compression spring, wherein, after the fuel cartridge is pushed into the housing portion to move backward the nozzle piston to a movable end thereof by the first compression spring, when the fuel cartridge is further pushed in, the nozzle piston pushes in the ejection nozzle so that the fuel gas is ejected from the ejection nozzle and supplied to a side of the coupling sleeve, wherein a tip end of the nozzle piston in an axial direction of the nozzle piston is closed, the nozzle piston includes an introduction hole extending in a direction intersecting said axial direction and formed near the tip end portion, two seal members are provided at an inner peripheral surface of the coupling sleeve with an interval therebetween, and when an ejection hole of the ejection nozzle extending in a direction intersecting said axial direction and the introduction hole are located between the seal members, the fuel gas is supplied from the ejection hole to the introduction hole.

11. The driving tool according to claim 10, wherein the nozzle piston is relatively slidable with respect to both of the two seal members.

12. A gas-combustion type driving tool comprising, a housing portion capable of loading a fuel cartridge from one end of the housing portion, the fuel cartridge including an ejection nozzle biased by a first compression spring and fuel gas being ejected when the ejection nozzle is pushed with respect to a cartridge main body against a biasing force of the first compression spring;

a coupling sleeve provided at an other end of the housing portion and capable of inserting the ejection nozzle of the fuel cartridge therein;

a nozzle piston slidably housed within the coupling sleeve and capable of abutting a tip end of the ejection nozzle; and a second compression spring for biasing the nozzle piston to a tip end portion side of the coupling sleeve, wherein a biasing force of the second compression spring is smaller than the biasing force of the first compression spring, wherein, after the fuel cartridge is pushed into the housing portion to move backward the nozzle piston to a movable end thereof by the first compression spring, when the fuel cartridge is further pushed in, the nozzle piston pushes in the ejection nozzle so that the fuel gas is ejected from the ejection nozzle and supplied to a side of the coupling sleeve, wherein a tip end of the nozzle piston in an axial direction of the nozzle piston is closed, two seal members are provided at an inner peripheral surface of the coupling sleeve with an interval therebetween, an introduction hole penetrating a side wall of the coupling sleeve is formed between the seal members, and when an ejection hole of the ejection nozzle extending in a direction intersecting said axial direction are located between the seal members, the fuel gas is supplied from the ejection hole to the introduction hole.

13. The driving tool according to claim 12, wherein the nozzle piston is relatively slidable with respect to both of the two seal members.

14. A gas-combustion type driving tool comprising:

a housing portion capable of loading a fuel cartridge from one end of the housing portion, the fuel cartridge including an ejection nozzle biased by a first compression spring and fuel gas being ejected when the ejection nozzle is pushed with respect to a cartridge main body against a biasing force of the first compression spring;

a coupling device provided at the other end of the housing portion and capable of inserting the ejection nozzle of the fuel cartridge therein;

a nozzle piston slidably housed within the coupling sleeve and capable of abutting a tip end of the ejection nozzle; and a second compression spring for biasing the nozzle piston to a tip end portion side of the coupling sleeve, wherein a biasing force of the second compression spring is smaller than the biasing force of the first compression spring, wherein, after the fuel cartridge is pushed into the housing portion to move backward the nozzle piston to a movable end thereof by the first compression spring, when the fuel cartridge is further pushed in, the nozzle piston pushes in the ejection nozzle so that the fuel gas is ejected from the ejection nozzle and supplied to a side of the coupling sleeve, and wherein the coupling sleeve includes an exhaust hole and the nozzle piston includes an introduction hole that locates at a position matching the exhaust hole of the coupling sleeve when the second compression spring biases the nozzle piston to the tip end portion of the coupling sleeve.

15. The driving tool according to claim 14, the tool main body is provided with a fuel measuring device.

16. The driving tool according to claim 14, wherein the cartridge main body is provided with an adapter sleeve at a periphery of the ejection nozzle, an inner plate having a fitting hole fitting to the ejection nozzle is slidably provided within the adapter sleeve, and the inner plate is biased in a direction of protruding toward an outside of the adaptor sleeve.

17. The driving tool according to claim 14, wherein a dust proof seal member which contacts with the nozzle piston in a standby state to prevent dust from entering an end portion of the coupling sleeve is provided at an inner peripheral surface of the end portion of the coupling sleeve.

* * * * *